US009173460B2

(12) United States Patent
Kaltenrieder

(10) Patent No.: US 9,173,460 B2
(45) Date of Patent: Nov. 3, 2015

(54) BRACELET CLASP

(71) Applicant: The Swatch Group Management Services AG, Biel/Bienne (CH)

(72) Inventor: Cedric Kaltenrieder, Courtelary (CH)

(73) Assignee: The Swatch Group Management Services AG, Biel/Bienne (CH)

( * ) Notice: Subject to any disclaimer, the term of this patent is extended or adjusted under 35 U.S.C. 154(b) by 0 days.

(21) Appl. No.: 14/519,668

(22) Filed: Oct. 21, 2014

(65) Prior Publication Data

US 2015/0121668 A1 May 7, 2015

(30) Foreign Application Priority Data

Nov. 7, 2013 (EP) ..... 13192011

(51) Int. Cl.
*A44C 5/24* (2006.01)

(52) U.S. Cl.
CPC ..... *A44C 5/24* (2013.01); *Y10T 24/2155* (2015.01); *Y10T 24/2166* (2015.01); *Y10T 24/4782* (2015.01)

(58) Field of Classification Search
CPC ..... A44C 5/24; A44C 5/243; A44C 5/246; Y10T 24/2155; Y10T 24/4782; Y10T 24/2166
USPC ..... 24/265 WS, 71 J, 265 B, 68 A, 265 BC, 24/265 EC, 70 J, 69 J, 68 J; 224/164, 171, 224/174, 177, 178
See application file for complete search history.

(56) References Cited

U.S. PATENT DOCUMENTS

| | | | | |
|---|---|---|---|---|
| 2,532,840 | A * | 12/1950 | Gaun | 24/71 R |
| 5,331,723 | A * | 7/1994 | Mathieu | 24/71 J |
| 5,689,859 | A * | 11/1997 | Cuche | 24/71 J |
| 5,857,243 | A * | 1/1999 | Champion | 24/71 J |
| 6,094,782 | A * | 8/2000 | Gay et al. | 24/71 J |
| 6,401,307 | B1 * | 6/2002 | Wild | 24/71 J |
| 6,434,798 | B1 * | 8/2002 | Yamakawa et al. | 24/71 J |
| 2002/0010985 | A1 * | 1/2002 | Thalheim | 24/71 J |
| 2004/0163217 | A1 * | 8/2004 | Ferrario | 24/71 J |
| 2012/0240359 | A1 | 9/2012 | Kaltenrieder | |
| 2012/0318018 | A1 * | 12/2012 | Mouche et al. | 63/3.1 |
| 2013/0255043 | A1 * | 10/2013 | Mace et al. | 24/493 |

FOREIGN PATENT DOCUMENTS

| | | | |
|---|---|---|---|
| CH | 703 294 | A2 | 12/2011 |
| DE | 10 2013 102 662 | A1 | 9/2013 |
| EP | 1 925 227 | A1 | 5/2008 |
| EP | 2 502 515 | A1 | 9/2012 |

OTHER PUBLICATIONS

European Search Report issued Apr. 22, 2014, in European Application No. 13192011 filed Nov. 7, 2013 (with English Translation).

* cited by examiner

*Primary Examiner* — Robert J Sandy
*Assistant Examiner* — Rowland Do
(74) *Attorney, Agent, or Firm* — Oblon, McClelland, Maier & Neustadt, L.L.P.

(57) ABSTRACT

The bracelet clasp includes a rectangular base element wherein each of the long sides is formed of side bars each formed of at least two leaf springs forming an elastic device allowing first and second folding parts to be locked onto said base element and disengaged therefrom when a pressure is exerted simultaneously on said side bars.

12 Claims, 4 Drawing Sheets

BRACELET CLASP

This application claims priority from European Patent application No. 13192011.8 filed Nov. 7, 2013, the entire disclosure of which is hereby incorporated herein by reference.

The present invention concerns a clasp of the type with a deployant buckle which may have two folding parts or a single folding part, the folding part(s) being hinged to a base element.

A first embodiment of the invention relates to a clasp of the type with a deployant buckle including a substantially rectangular base element whose first and second long sides are formed respectively of first and second side bars, and first and second pivoting folding parts hinged on first and second sides of said base element, said folding parts being arranged to be folded down onto said base element and held there in response to an elastic device associated with a locking and unlocking mechanism acting on said base element and said folding parts to respectively allow said first and said parts to lock onto said base element and then be disengaged therefrom.

Bracelet clasps answering the description given in the above paragraph are known in the state of the art.

EP Patent No 1925227B1 discloses a clasp formed of a base and two folding parts arranged to be folded down onto the base and held there in response to an elastic device formed of one or two helical springs. In order to avoid using these springs and to simplify the construction of the clasp, CH Patent No 703294 proposes a clasp formed of a base element onto which two folding parts can be folded down and held locked on by varying the elasticity contained in the side bars forming the base element (see in particular FIG. 3 of said Patent). Pressing on the push-pieces integrated in the side bars releases the folding parts from any engagement and makes it possible to open the clasp.

However, the solution proposed by CH Patent No 703294 raises a question, which consists in ensuring that the base element has high rigidity of construction while providing the side bars of which it is composed the elasticity necessary to hold the folding element properly on the base element and allowing said folding parts to be released when a force is exerted on said side bars.

To provide a response to the question raised above, the present invention not only complies with the generic definition set out in the second paragraph of this description relating to the first embodiment of the invention, but is remarkable in that the base element includes first and second side bars each formed of at least two leaf springs which form said elastic device, and a pressure simultaneously exerted on each of the side bars causes the unlocking of said folding parts from said base element.

A second embodiment of the invention relates to a clasp of the type with a deployant buckle including a substantially rectangular base element whose first and second long sides are respectively formed of first and second rigid arms and a pivoting folding part hinged on one of the small sides of said base element, said folding part including first and second side bars, said folding part being arranged to be folded down onto said base element and held there in response to an elastic device associated with a locking and unlocking mechanism acting on said base element and said folding part to respectively allow said folding element to be engaged on said base element and then disengaged therefrom.

A clasp which substantially answers the description given in the above paragraph is set out in EP Patent No 2502515, which describes a clasp formed of a base including two rigid arms and a folding part arranged to be folded down onto the base and held locked thereon by varying the elasticity contained in the side bars forming said folding part (see in particular FIG. 1 of said folding part). Pressing on the push-pieces integrated in the side bars releases the folding part from any engagement and makes it possible to open the clasp.

However, the solution proposed by this Patent raises a question, which consists in ensuring that the folding part has high rigidity of construction while providing the side bars of which it is composed the elasticity necessary to hold said folding part properly on said base element and limiting said folding part when a force is exerted on said side bars.

To provide a response to the question raised above, the present invention not only complies with the generic definition set out in the paragraph above relating to the second embodiment of the invention, but is remarkable in that the folding part includes first and second side bars each formed of at least two leaf springs which form said elastic device, and a pressure simultaneously exerted on each of the side bars causes the unlocking of said folding part from said base element.

The features and advantages of the present invention will appear from the following description, given with reference to the annexed drawings, and providing, by way of explanatory, but non-limiting example, two advantageous embodiments of a clasp. In the drawings.

Drawings 1 to 5 relate to the first embodiment of the clasp according to the invention. The first embodiment will now be explained in detail.

Figure 1:
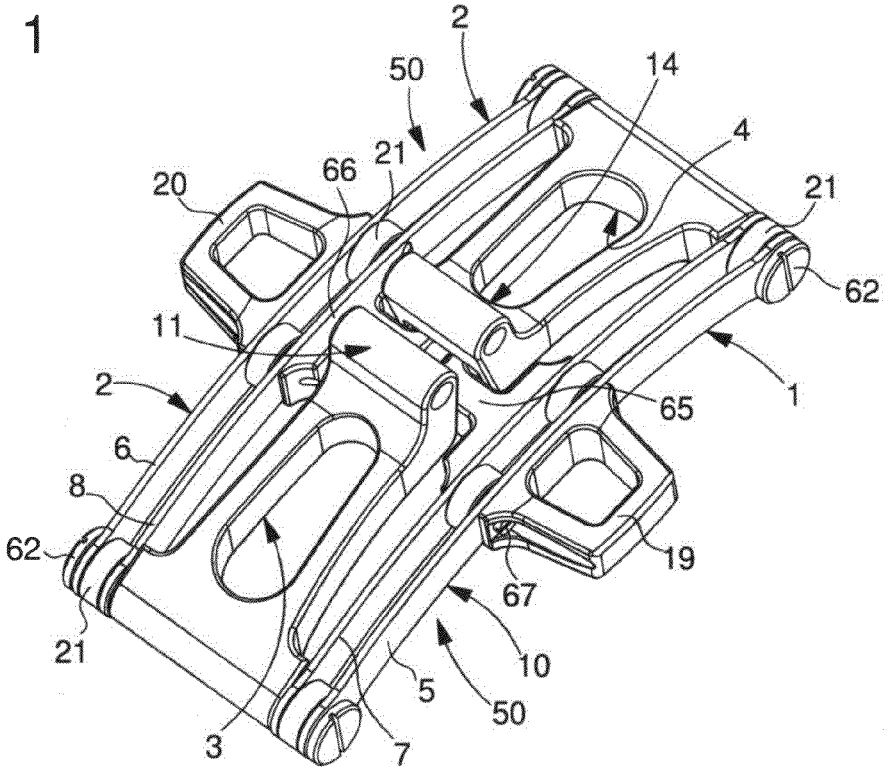
FIG. 1 is a perspective view of the clasp according to the invention created according to the first embodiment wherein two folding parts are folded down on the base element.
Figure 2:
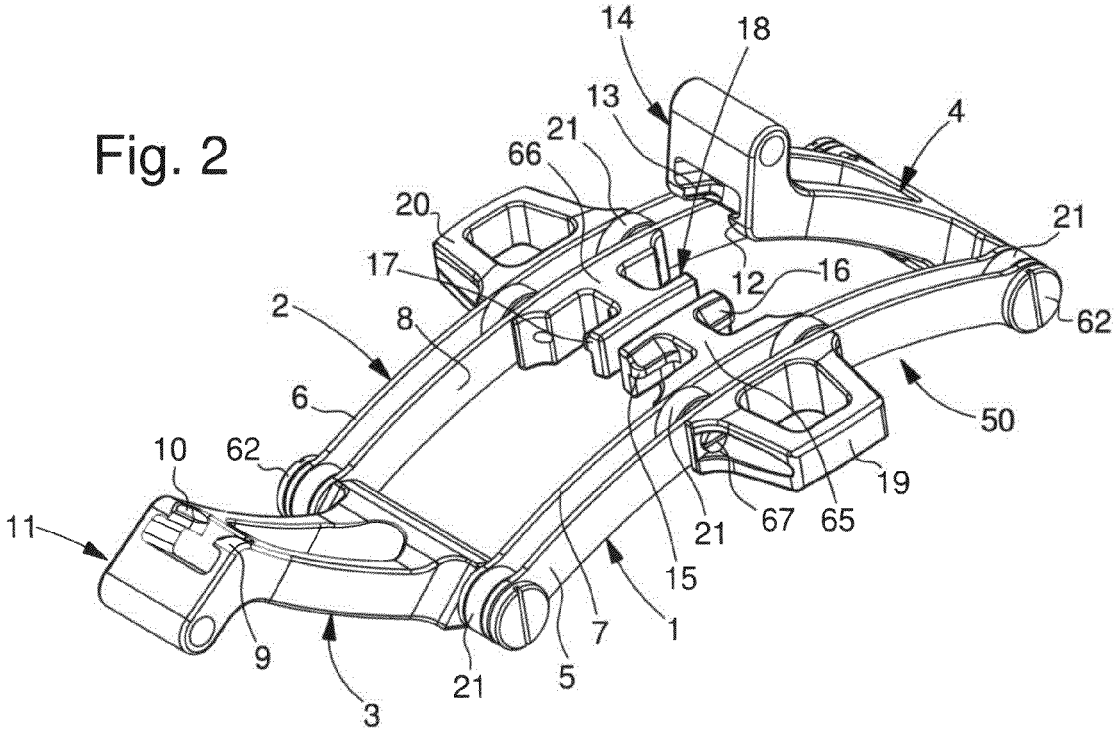
FIG. 2 is a perspective view of the clasp created according to FIG. 1, the folding parts being shown disengaged from the base element.
Figure 3:
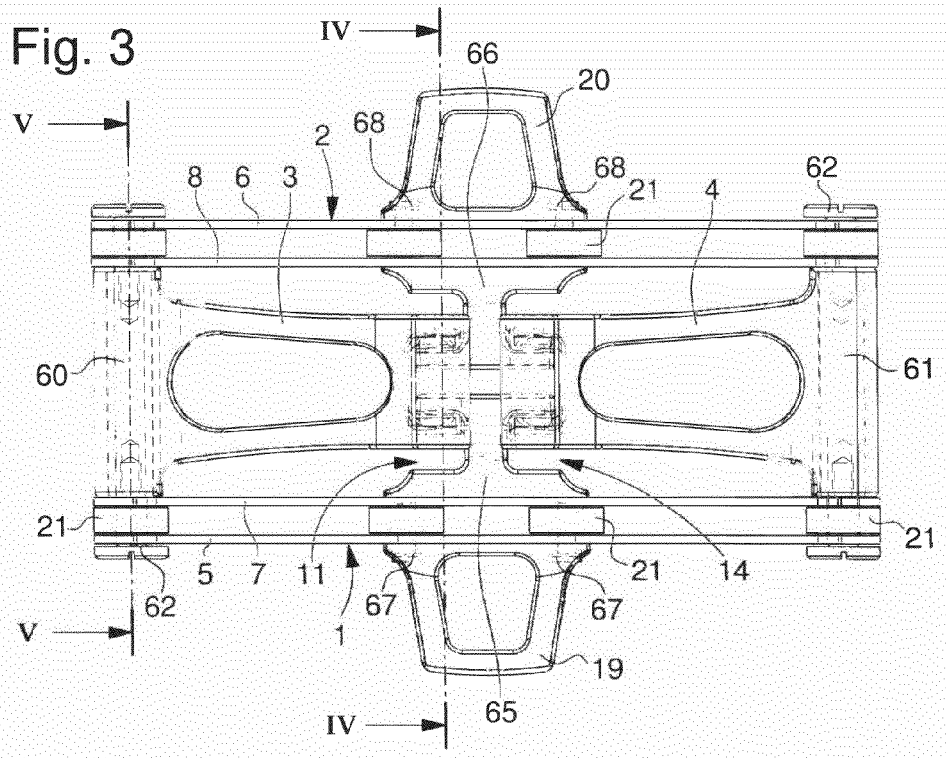
FIG. 3 is a plan view of the clasp created according to FIG. 1.

FIGS. 1 and 2 are perspective views of the bracelet clasp of the type with a deployant buckle which includes a substantially rectangular base element 50. This element includes first and second long sides respectively formed of first 1 and second 2 side bars. The clasp also includes first 3 and second 4 folding parts which are pivotally mounted and hinged respectively on the first and second small sides of base element 50 about first 60 and second 61 arbors, said arbors being held in place by screws 62. Folding parts 3 and 4 are arranged to be folded down on base element 50 and in particular inside said element as clearly illustrated in FIGS. 1 to 5. Said folding parts 3 and 4 are held in a folded down position on base element 50 in response to an elastic device associated with a locking and unlocking mechanism acting on said base element 50 and said folding parts 3 and 4 to respectively allow said first 3 and second 4 folding parts to be locked onto said base element 50 and then disengaged therefrom.

With respect to the above description, in principle known from prior art documents, the clasp of the present invention differs in the originality of the elastic device implemented which consists in proposing first 1 and second 2 side bars each formed of at least two leaf springs. In the drawings of FIGS. 1 to 5, first side bar 1 carries leaf springs 5 and 7, and second side bar 2 carries leaf springs 6 and 8.

The present invention therefore proposes at least two leaf springs for equipping each of the side bars forming the long sides of the base element and not a single leaf, for the sake of ensuring good rigidity of said base element and thereby preventing any warping thereof. Further, the use of thin leaf springs, in principle, provides several advantages. They are economical to manufacture since they can easily be cut, the means used for cutting being selected according to the materials chosen for making the leaves, such as for example, water jet, laser or stamping means. Another advantage lies in the wide choice of materials available, for example composites, amorphous metals or spring steels. Finally, it can be mentioned that the properties of the leaf springs can be modified in several manners, among which the following can be mentioned: cutting the leaves in sheets of smaller or larger thickness, stacking the leaves and changing their base material.

Here stacking at least two leaf springs doubles the stiffness of the spring while maintaining the deflection provided by a single leaf spring.

If three leaf springs were used, the stiffness of the assembly would be tripled according to the formula:

$$K=nk$$

where K is the stiffness of the assembly, n the number of leaf springs and k the stiffness of one leaf spring. In other words, with at least two leaf springs equipping each of the side bars, the force necessary to disengage the folding parts from the base element is doubled, while maintaining the same path to be travelled for disengagement.

Figure 4:
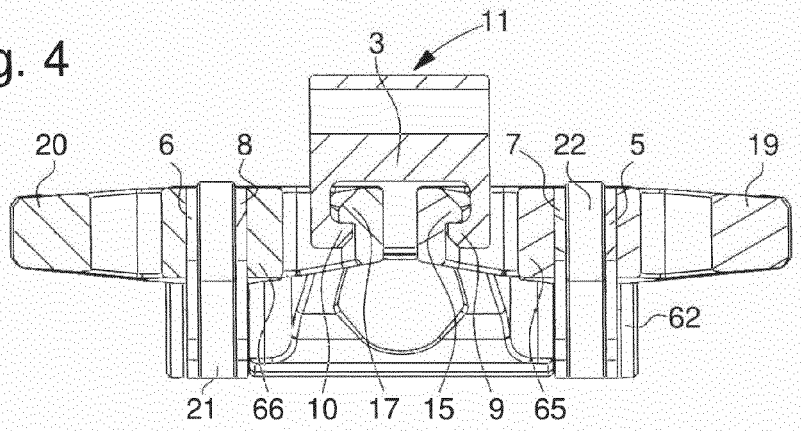
FIG. 4 is a cross-section along the line IV-IV of FIG. 3.
Figure 5:
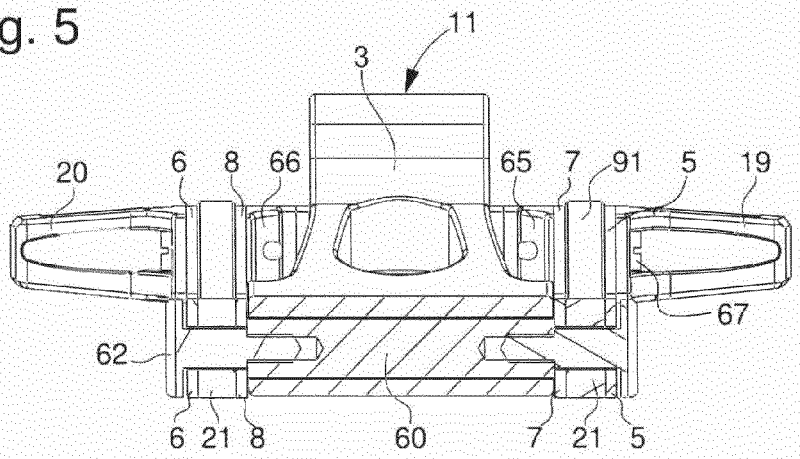
FIG. 5 is a cross-section along the line V-V of FIG. 3.

The locking and unlocking mechanism implemented for respectively engaging and disengaging the first 3 and second 4 folding parts on base element 50 will now be described. FIGS. 2 and 4 show that this mechanism is composed of first 9 and second 10 hooks carried by the free end 11 of first folding part 3 and third 12 and fourth 13 hooks carried by the free end 14 of second folding part 4. Said first 9 and third 12 hooks are arranged to be respectively locked by first 15 and second 16 locks carried by said first side bar 1 and said second 10 and fourth 13 hooks are arranged to be respectively locked by third 17 and fourth 18 locks carried by said second side bar 2.

FIGS. 1 to 4 show more particularly that the first 15 and second 16 locks are moulded in a first element 65 carried by said first side bar 1 and that the third 17 and fourth 18 locks are moulded in a second element 66 carried by said second side bar 2.

It will be understood that a lateral pressure exerted on each of side bars 1 and 2 will move together locks 15 and 17 (see FIG. 4) and locks 16 and 18 (see FIG. 2) to respectively disengage hooks 9 and 10 integral with first folding part 3 and hooks 12 and 13 integral with second folding part 4. The clasp is then in the process of opening. To facilitate the manual action exerted on each of the side bars, first 19 and second 20 push-pieces are respectively secured to said first 1 and second 2 side bars. FIGS. 1, 2, 3 and 5 further show that first 67 and second 68 screws are provided to respectively secure the assembly formed by first push-piece 19, first side bar 1 and first element 65 and the assembly formed by second push-piece 20, second side bar 2 and second element 66.

The leaf springs 5, 7 forming first side bar 1 and leaf springs 6, 8 forming second side bar 2 may be mounted contiguously and the drawings do not illustrate this construction. The Figures show that these leaf springs are separated by solid spacers 21. This avoids problems that may be caused by friction and corrosion between the leaf springs. It is to be noted that these spacers also reduce possible warping of the base element, that is to say they increase its resistance to torsion. It will also be noted that the spaces left free between the solid spacers 21 could be filled with a soft filler material, for example rubber.

Although not shown in the Figures, it goes without saying that a first bracelet strand is fixed to the free end 11 of first folding part 3 and a second bracelet strand is fixed to the free end 14 of second folding part 4.

FIGS. 6 to 9 relate to a second embodiment of the clasp made according to the invention. This second embodiment will now be explained in detail.

Figure 6:
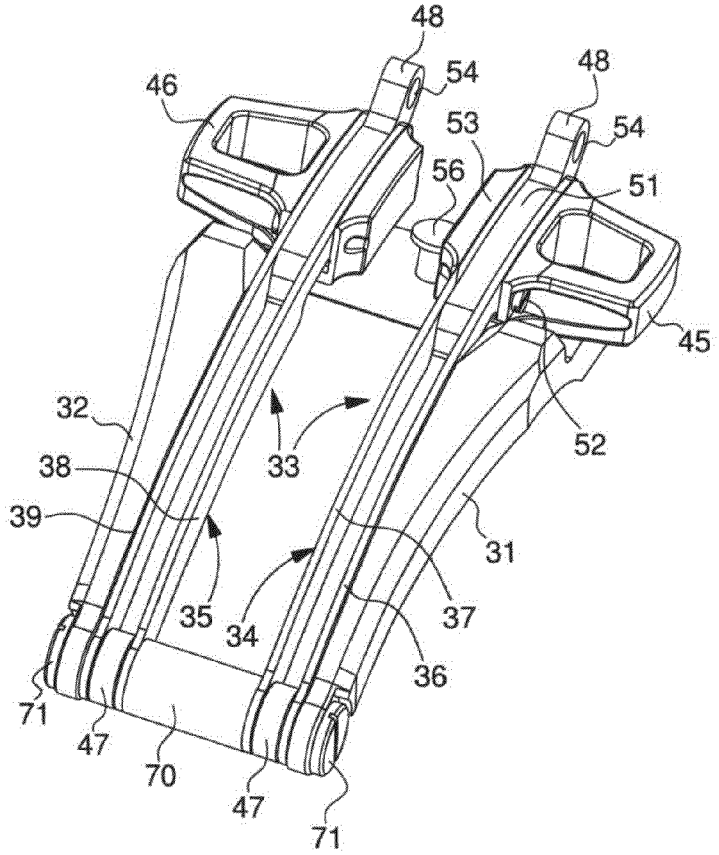
FIG. 6 is a perspective view of the clasp according to the invention created according to the second embodiment wherein a single folding part is folded down on the base element.
Figure 7:
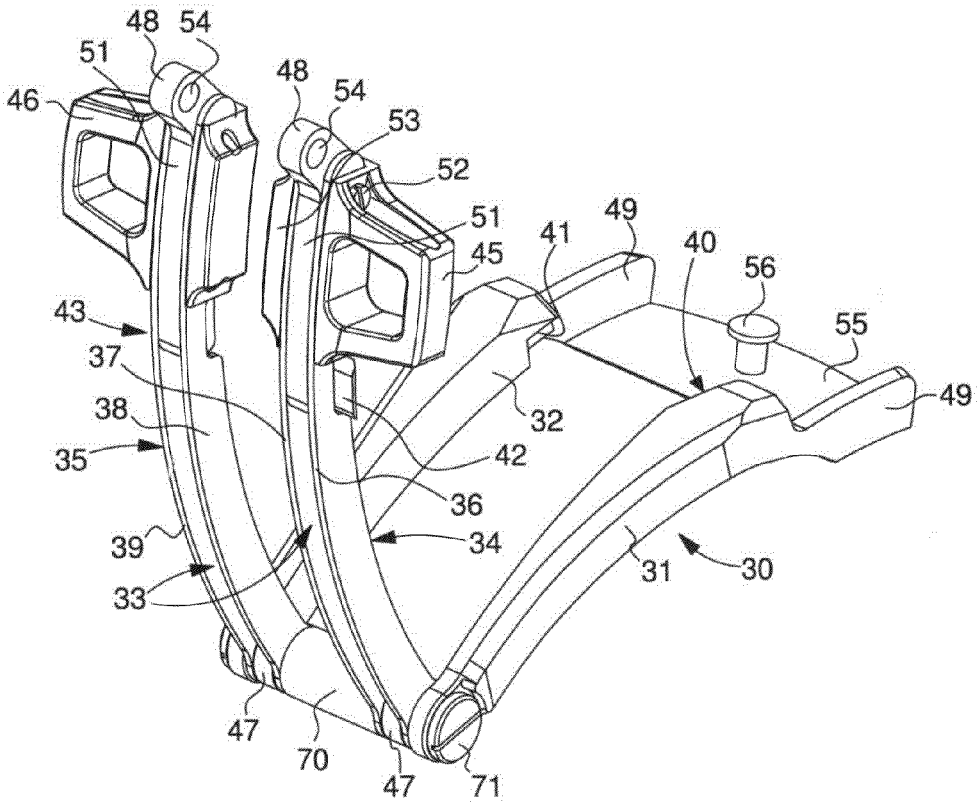
FIG. 7 is a perspective view of the clasp created according to FIG. 6, the folding part being shown disengaged from the base element.

FIGS. 6 and 7 are perspective views of the bracelet clasp with a deployant buckle which includes a substantially rectangular base element 30. This element includes first and second long sides respectively formed of first 31 and second 32 rigid arms. The clasp further includes a folding part 33 which is pivotally mounted and hinged on one of the small sides of said base element 30 about an arbor 70 forming said small side, this arbor being held in place by screws 71. Folding part 33 includes first 34 and second 35 side bars and is arranged to be folded down on base element 30 and particularly inside said element as clearly illustrated in FIGS. 6, 7 and 8. Folding part 33 is held in position folded down on base element 30 in response to an elastic device associated with a locking and unlocking mechanism acting on said base element 30 and said folding part 33 to respectively allow said folding part 33 to be locked onto said base element 30 and then disengaged therefrom.

With respect to the above description, the clasp of the present invention differs in the originality of the elastic device implemented which consists in proposing first 34 and second 35 side bars each formed of at least two leaf springs. In the drawings of FIGS. 6 to 9, first side bar 34 carries leaf springs 36 and 37, and second side bar 35 carries leaf springs 38 and 39.

The present invention therefore proposes at least two leaf springs for equipping each of the side bars equipping the folding part and not a single leaf spring, for the sake of ensuring good rigidity of said folding part and thus preventing warping of the side bars. Further, the use of thin leaf springs in principle provides the same advantages as those listed above in relation to the first embodiment of the clasp and the reader may refer to that part of the description.

Figure 8:
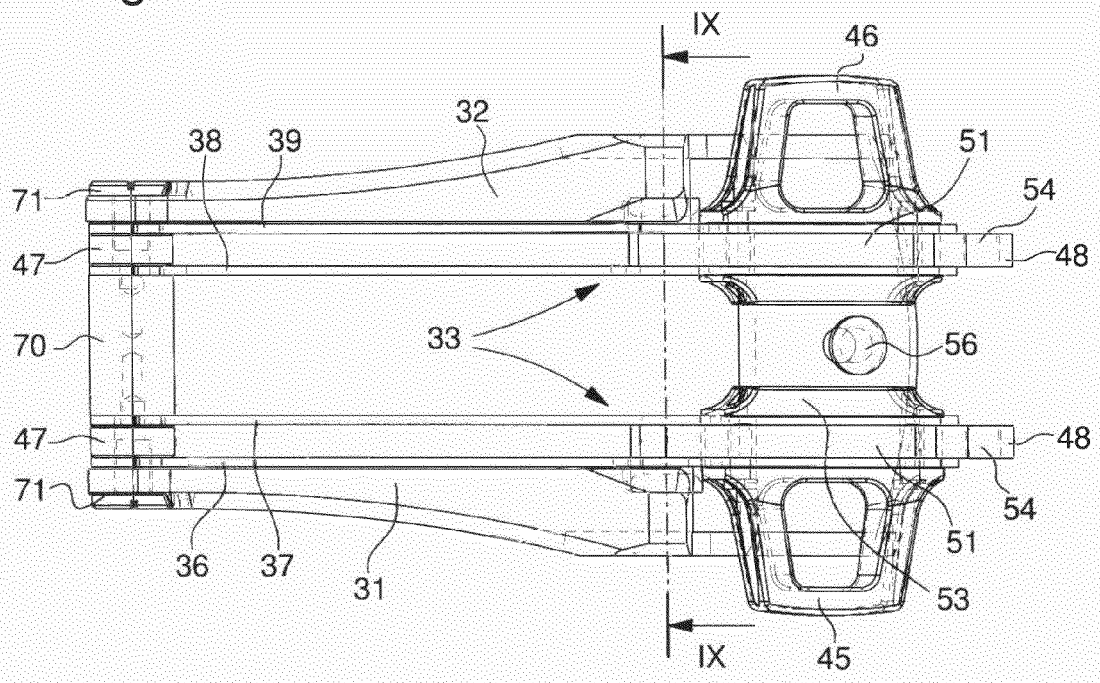
FIG. 8 is a plan view of the clasp created according to FIG. 6.
Figure 9:
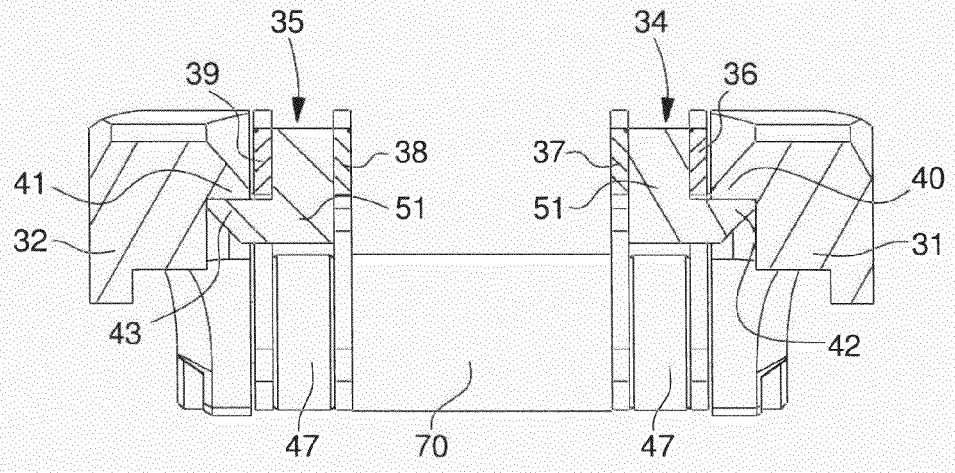
FIG. 9 is a cross-section along the line IX-IX of FIG. 8.

The locking and unlocking mechanism respectively implemented for locking on and disengaging folding part 33 from base element 30 will now be described. FIGS. 7 to 9 show that this mechanism is formed of first 40 and second 41 hooks respectively carried towards the free end 49 of first 31 and second 32 rigid arms. Said first 40 and second 41 hooks are arranged to be locked respectively by first 42 and second 43 locks respectively carried by said first 34 and second 35 side bars towards the free end of the leaf springs of which said bars are formed.

It will be understood that a lateral pressure exerted on each of side bars 34 and 35 will move locks 42 and 43 closer together and respectively release them from hooks 40 and 41 carried by rigid arms 31 and 32 of base element 30 (see FIG. 9). The clasp is then in the process of opening. To facilitate the manual action exerted on each of the side bars, first 45 and second 46 push-pieces are respectively secured to said first 34 and second 35 side bars.

The leaf springs 36, 37 forming first side bar 34 and leaf springs 38, 39 forming second side bar 35 may be mounted contiguously and the drawings do not illustrate this construction. Here the Figures show that these leaf springs are separated by solid spacers, denoted 47 for those which separate the leaf springs at the hinge point to base element 30 and 51 for those which separate said leaf springs at their free end. This therefore avoids problems which may be caused by friction and corrosion between the leaf springs, as already stated with reference to the first embodiment. It will be noted that, here too, the space left free between the leaf springs could be filled with a soft material, for example rubber.

Several constructions may be envisaged for equipping the free end of each of side bars which includes a push-piece, two leaf springs, a spacer and a lock. FIGS. 6 and 7 propose one of these constructions. Here an elongated spacer 51 is sandwiched between leaf springs 36 and 37 forming side bar 34. Formed in one-piece with spacer 51, lock 42 is capable of being retained by hook 40 carried by rigid arm 31 of base element 30. Push-piece 45 is fixed to side bar 34 on the outer face of first leaf spring 36 via screws 52 screwed into a reverse piece 53 applied to the outer face of second leaf spring 37. The same construction is adopted for side bar 35.

It will also be mentioned that a first bracelet strand is fixed to the free end 48 of folding part 33, particularly the 12 o'clock strand if the bracelet is attached to a watch. Here the fastening will be achieved, for example, by means of a bar passing through holes 54 made at the end of spacers 51.

Likewise, at the free end 49 of base element 30 is arranged a bridge 55, which connects the first 31 and second 32 rigid arms, and to which is fixed a stud 56, intended to receive a second bracelet strand, particularly the 6 o'clock strand provided with perforations. This fastening also allows the length of the bracelet to be adjusted.

What is claimed:

1. A bracelet clasp with a deployant buckle including a substantially rectangular base element whose first and second long sides are respectively formed of first and second side bars, and first and second pivoting folding parts hinged respectively on first and second small sides of said base element, said folding parts being arranged to be folded down onto said base element and held there in response to an elastic device associated with a locking and unlocking mechanism acting on said base element and said folding parts to respectively allow said first and second folding parts to be locked onto said base element and then disengaged therefrom, wherein the first and second side bars are each formed of at least two leaf springs which form said elastic device, a pressure simultaneously exerted on each of the side bars causing the unlocking of said folding parts from said base element.

2. The clasp according to claim 1, wherein the locking and unlocking mechanism is formed of first and second hooks carried by the free end of the first folding part and third and fourth hooks carried by the free end of the second folding part, said first and third hooks being arranged to be respectively locked by first and second locks carried by said first side bar and said second and fourth hooks being arranged to be respectively locked by third and fourth locks carried by said second side bar.

3. The clasp according to claim 1, wherein the first and second side bars respectively carry first and second push-pieces.

4. The clasp according to claim 1, wherein said leaf springs each forming said first and second side bars are contiguously mounted.

5. The clasp according to claim 1, wherein said leaf springs each forming said first and second side bars are separated by solid spacers.

6. The clasp according to claim 1, wherein a first bracelet strand is fixed to the free end of said first folding part and a second bracelet strand is fixed to the free end of said second folding part.

7. A bracelet clasp with a deployant buckle including a substantially rectangular base element whose first and second long sides are respectively formed of first and second rigid arms, and a pivoting folding part hinged on one of first and second small sides of said base element, said folding part including first and second side bars, said folding part being arranged to be folded down onto said base element and held there in response to an elastic device associated with a locking and unlocking mechanism acting on said base element and said folding part to respectively allow said folding part to be locked onto said base element and then disengaged therefrom, wherein the first and second side bars are each formed of at least two leaf springs which form said elastic device, a pressure simultaneously exerted on each of the side bars causing the unlocking of said folding part from said base element.

8. The clasp according to claim 7, wherein the locking and unlocking mechanism is formed of first and second hooks respectively carried towards the free end of said first and second rigid arms, said first and second hooks being arranged to be locked respectively by first and second locks carried respectively by said first and second side bars.

9. The clasp according to claim 7, wherein the first and second side bars respectively carry first and second push-pieces.

10. The clasp according to claim 7, wherein the leaf springs each forming the first and second side bars are contiguously mounted.

11. The clasp according to claim 7, wherein the leaf springs each forming the first and second side bars are separated by solid spacers.

12. The clasp according to claim 7, wherein a first bracelet strand is fixed to the free end of the folding part and a second bracelet strand is fixed to the free end of the base element.

* * * * *